United States Patent [19]

Acton et al.

[11] Patent Number: 4,861,108

[45] Date of Patent: Aug. 29, 1989

[54] AUDITORIUM SEAT

[75] Inventors: Hugh C. Acton, Augusta; Robert S. Walworth, Grand Rapids, both of Mich.

[73] Assignee: American Seating Company, Grand Rapids, Mich.

[21] Appl. No.: 203,742

[22] Filed: Jun. 7, 1988

[51] Int. Cl.[4] ..... A47C 5/04

[52] U.S. Cl. ..... 297/445; 297/354; 297/301

[58] Field of Search ..... 297/445, 446, 447, 452, 297/419, 301, 302, 303, 333, 354, 353, 355

[56] References Cited

U.S. PATENT DOCUMENTS

| | | | |
|---|---|---|---|
| 1,437,630 | 12/1922 | Zimmerli | 297/353 |
| 2,560,925 | 7/1951 | Brown | 297/353 X |
| 2,796,920 | 6/1957 | Cowles | 297/353 X |
| 2,913,039 | 11/1959 | Maser | 297/333 X |
| 3,163,409 | 12/1964 | Running et al. | 297/302 X |
| 3,820,845 | 6/1974 | Persson | 297/445 |
| 4,049,315 | 9/1977 | Jacobson | 297/447 |
| 4,575,150 | 3/1986 | Smith | 297/301 X |
| 4,756,575 | 7/1988 | Dicks | 297/353 X |

*Primary Examiner*—Peter A. Aschenbrenner

*Attorney, Agent, or Firm*—Waters, Morse & Harrington

[57] ABSTRACT

This auditorium seat has a frame preferably formed of bent steel tubing, the ends being brought together to parallelism in a "Y"-shaped configuration to form a pedestal. A seat is pivotally mounted on a spring hinge assembly between the sides of the frame, and includes a transverse saddle platform to which a "U"-shaped rod extends forward from end-receptacles on the platform. Seat-supporting straps are welded to the central portion of the "U"-shaped member to form a complex bending-torsion deflection system in addition to the cushioning effect of a pad interposed between the plates and the saddle. The back of the chair has limited freedom of articulation about horizontal and vertical axis, with a spring cushion providing a biasing action toward a neutral no-load position. A modified form of the invention provides a tablet arm assembly supported by a bracket embracing one side of the frame at a curved portion.

21 Claims, 10 Drawing Sheets

AUDITORIUM SEAT

BACKGROUND OF THE INVENTION

The design and construction of auditorium seating is a highly evolved art. In addition to the obvious requirements of comfort and aesthetic effect, the units must have a retracted position providing walking freedom. They must present a minimum of obstruction to the legs and feet of the occupants of both the particular seat and the one behind. Since depth of the structure in the front-rear direction influences row spacing, this factor is also important. Each installation may include thousands of units, so total cost is a prime consideration.

Blending all these design criteria has produced a wide variety of structural details. Most designs include some form of floor-mounted frame, a seat that can be tipped up for walking freedom, and some form of fixed or articulating back. It is rare to find a structure that satisfies all the physical requirements in an economical configuration that has aesthetic appeal.

SUMMARY OF THE INVENTION

The frame, seat, and back construction features of this invention are interrelated to provide economy and aesthetic appeal. The frame is preferably a loop of bent steel tubing, with the ends brought together toward parallelism in a "Y" configuration to form a pedestal. The upper portion of the loop is bent to a horizontal plane to form the arms and back support. Parallel sides of the loop form the points of pivotal mounting of the seat. The seat frame is based on a saddle providing a central support panel, and having side flanges to which the pivot mechanism is secured. A "U"-shaped cantilever spring rod extends forwardly from where it is secured to the saddle, and plates for supporting a seat cushion are secured to the central forward portion of this spring rod. A resilient pad is interposed between the plates and the saddle panel. The back is supported by interleaved "U" brackets connected by a hinge pin. One of the brackets is secured to the frame, and the other to the back unit, the two brackets having limited freedom of movement in a horizontal plane. A resilient pad is interposed between the brackets to bias the back to a no-load position. A modification of the invention provides a bracket for supporting a tablet arm assembly of otherwise conventional design, the bracket having a recess mating with the curved configuration at the front of the arm support, and embracing the upper portion of the frame member, which is elongated in a generally vertical direction.

DESCRIPTION OF THE PREFERRED EMBODIMENTS

Figure 1:
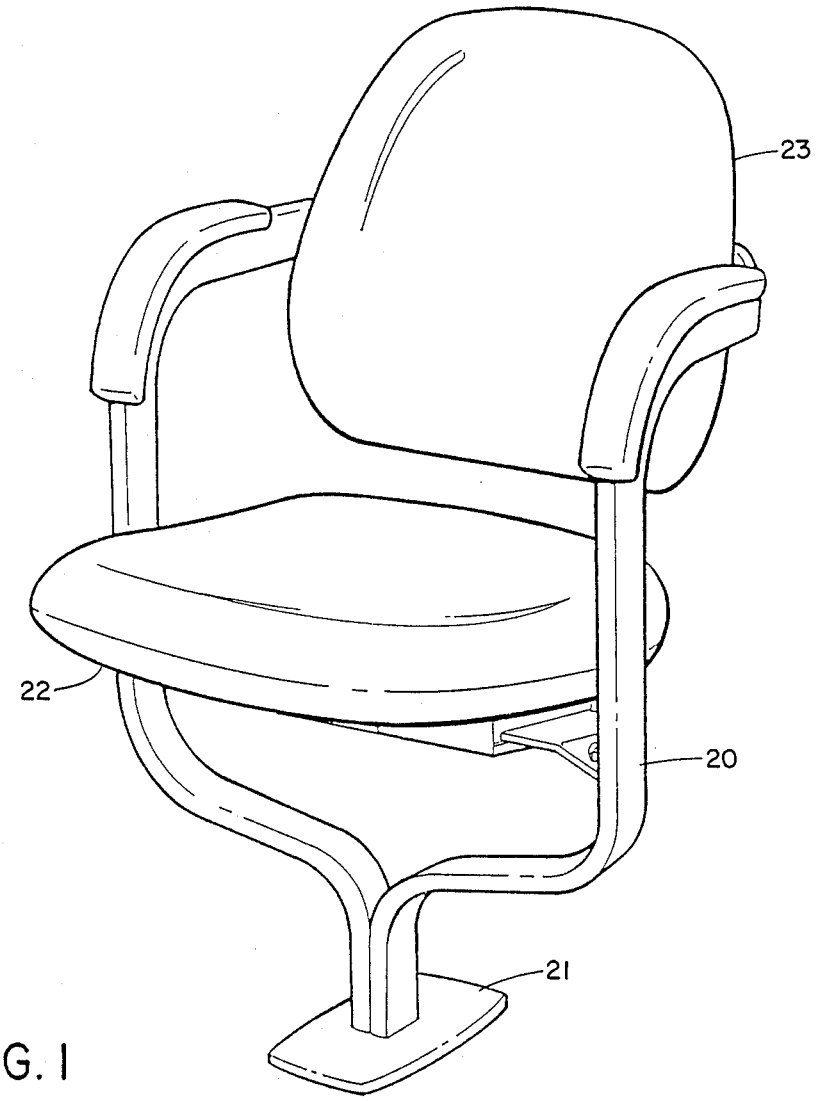
FIG. 1 is a front perspective view of the seat, with the seat cushion down in the "in use" position.
Figure 2:
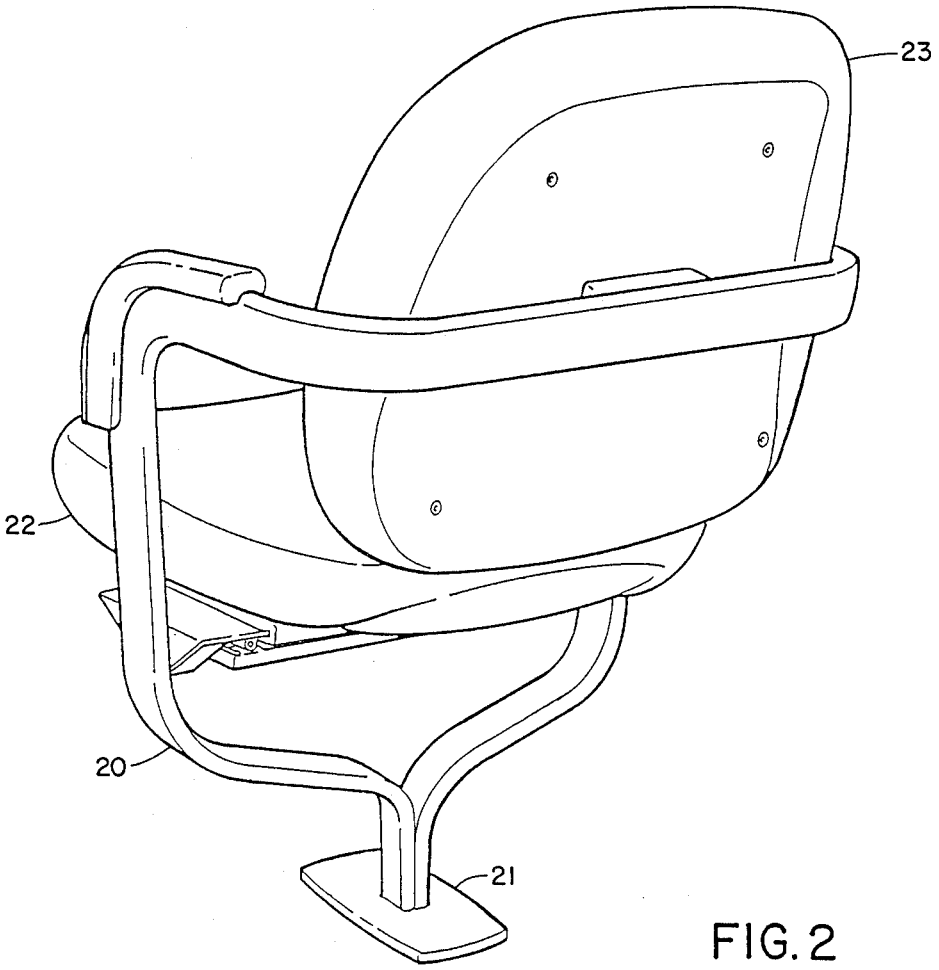
FIG. 2 is a rear perspective view of the unit shown in FIG. 1.
Figure 3:
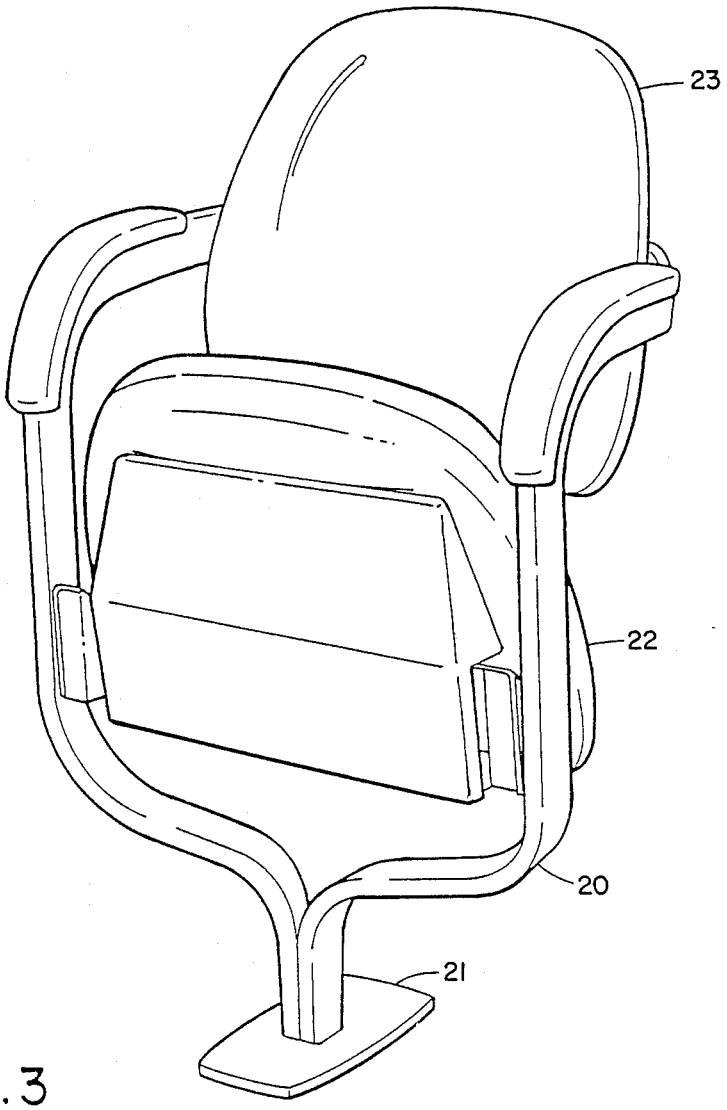
FIG. 3 is a view similar to FIG. 1, showing the seat in the up, or retracted position.
Figure 4:
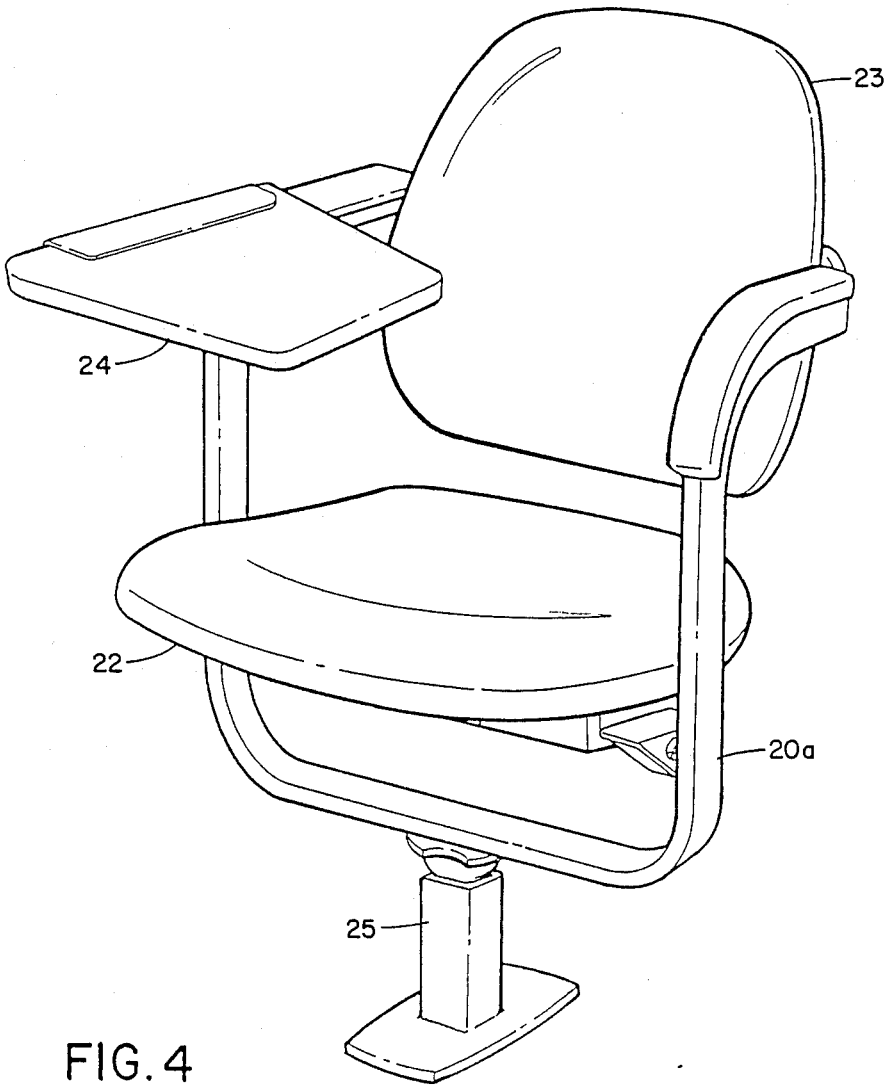
FIG. 4 is a modification of the design shown in FIG. 1, incorporating a swivel base and a tablet arm.

Referring to FIGS. 1–3, the illustrated auditorium seat has a frame 20 secured to a base 21, a seat assembly 22 pivotally mounted on the frame 20, and a back 23 mounted on the frame 20 with a limited freedom of articulation. The modification of the invention shown in FIG. 4 includes a tablet arm 24 and a swivel base 25. The structure of this base is conventional. The frame **20*a*** is modified to accept this base. The bases are bolted to the floor.

Figure 6:
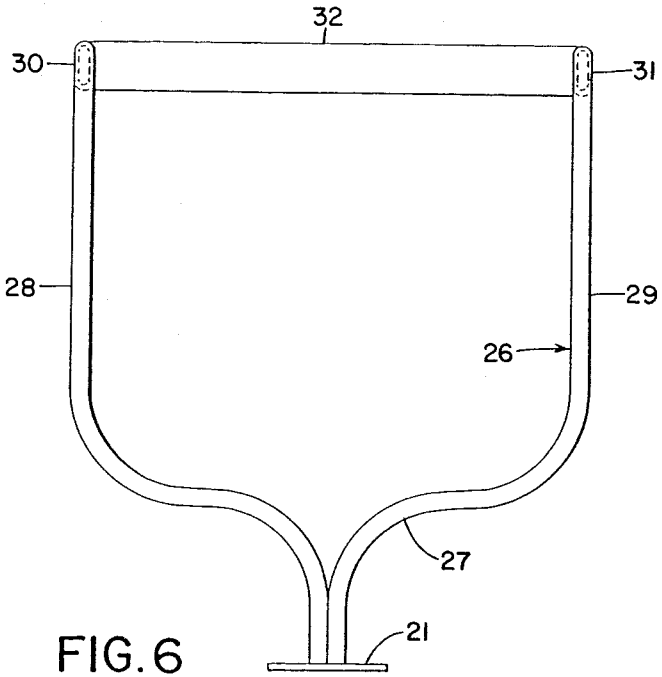
FIG. 6 is a front elevation of the frame shown in FIG. 5.
Figure 5:
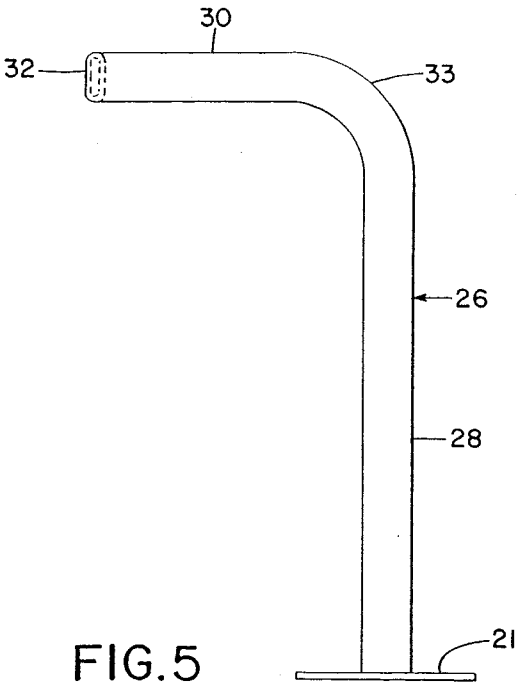
FIG. 5 is elevation of the "Y"-pedestal frame.

The frame of the chair shown in FIGS. 1–3 is illustrated in FIGS. 5 and 6. A piece of steel tube 26 is bent into a loop, with the ends brought together to parallelism in a "Y" configuration as shown at 27 to form a pedestal. This lower configuration merges into parallel sides 28 and 29. The closed end of the loop is bent to a horizontal plane to form the arm supports 30 and 31, and the back support 32. The junction of the arm supports and the sides of the frame produces the arcuate configuration shown at 33 in FIG. 5. The cross-section of the tube 26 is elongated in a front-rear direction over the lower portion of the frame, and in a vertical direction over the arm and back supports.

Figure 7:
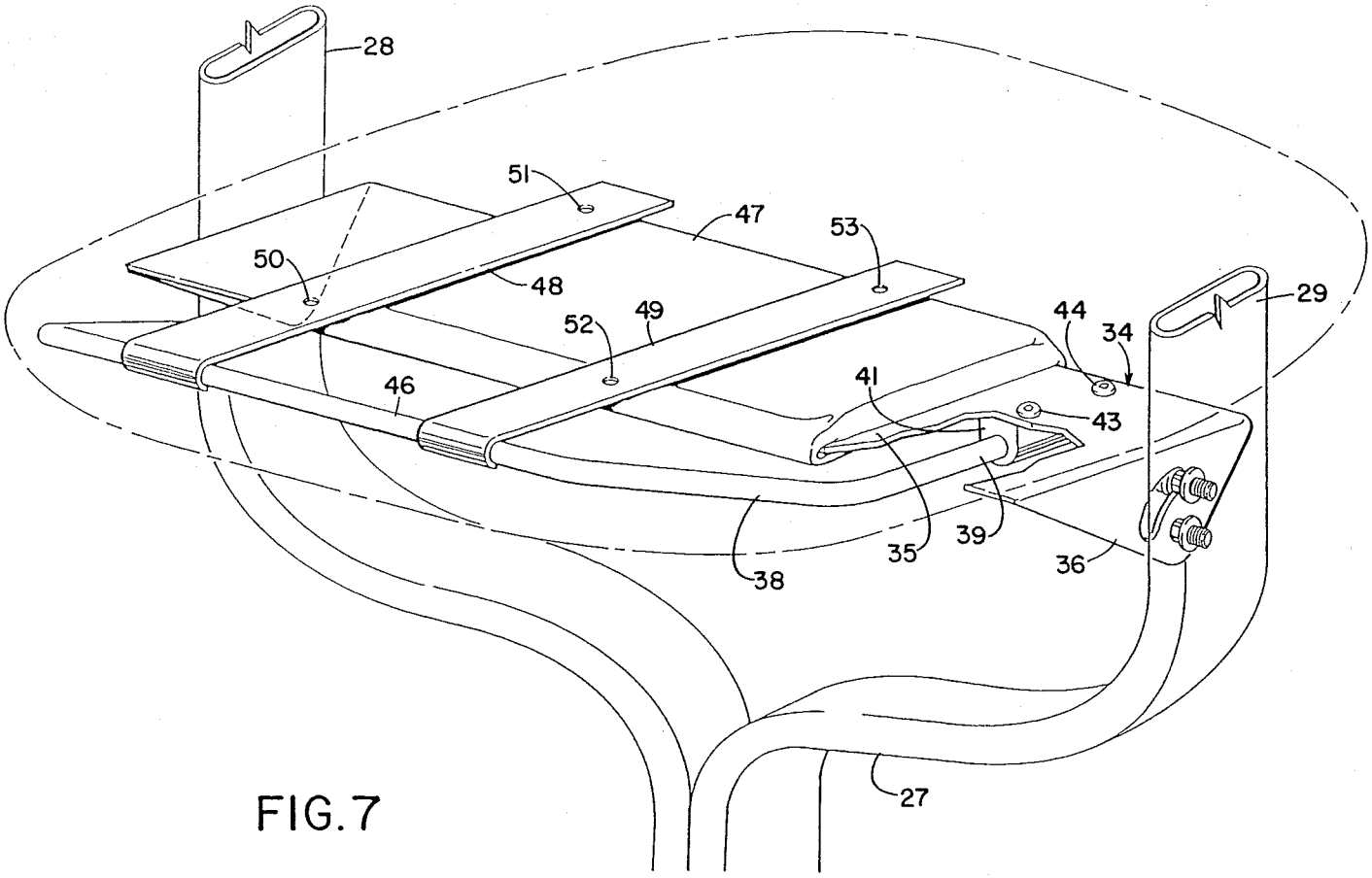
FIG. 7 is a perspective view showing the construction of the seat frame, with the cushion shown in phantom lines.
Figure 9:
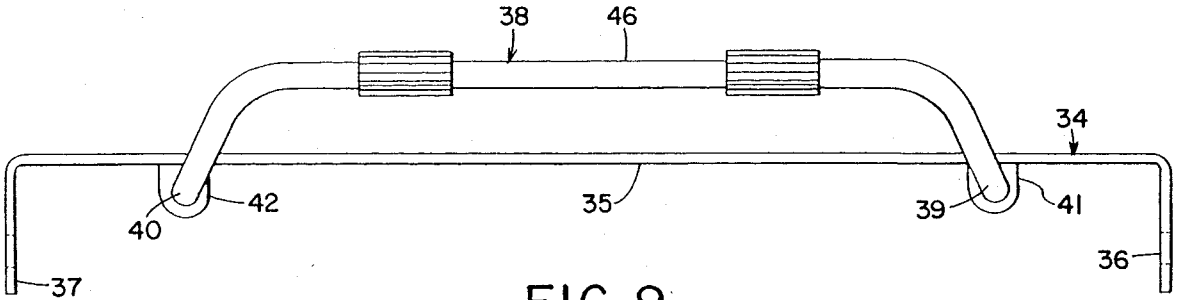
FIG. 9 is a front elevation of the seat frame.
Figure 8:
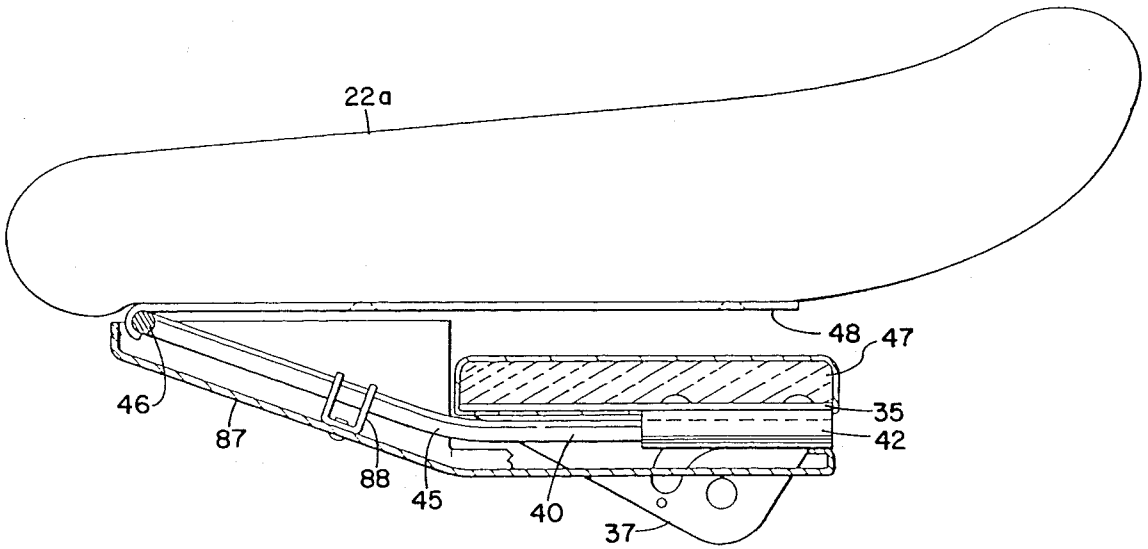
FIG. 8 a section through the center of the seat frame, on a vertical front-rear plane.

Referring to FIGS. 7–9, the construction of the seat frame includes a saddle 34 having a central plate portion 35 and opposite end flanges 36 and 37. A "U"-shaped cantilever spring rod 38 has its ends 39 and 40 received respectively in the receptacles 41 and 42 secured to the plate portion 35 of the saddle by screws as indicated at 43 and 44. An offset as shown at 45 raises the frontal portion 46 above the plane of the central portion 35 to permit the upholstered pad 47 to be interposed between the plate section 35 of the saddle and the resilient spring steel strips 48 and 49 acting as support plates for the cushion **22*a*. These strips 48 and 49 are welded to the central portion 46, but rest above on the top of the pad 47 in the no-load condition. The strips are simply screwed to the underside of the seat cushion 22*a*. This assembly produces a rather unusual spring action. Load placed on the rear portion of the seat will be transferred, after initial bending deflection of the strips 48 and 49, primarily through the pad to the central portion of the saddle to which it is bonded, but deflection of the pad under compression will produce a tendency to resiliently deflect the saddle itself and to further deflect the strips 48 and 49, and to twist the strips downward with respect to the central portion 46 of the rod 38. Since the strips are fixed with respect to the central portion of the rod, such deflection induces a torsional deflection of the rod itself. The combination of these effects produces a very considerable degree of resilience for a given vertical depth of structure. Load placed on the frontal portion of the seat will obviously be supported primarily by the rod 38, which will deflect in the manner of a cantilever spring. The cantilever spring and multiple strips 48 and 49 permit the seat to deflect downwardly more on one side than another to accommodate the position of the occupant. The seat cushion is of standard construction, and includes a base panel (not shown) into which screws can be run through holes as shown at 50–53 in the straps 48 and 49**.

Figure 11:
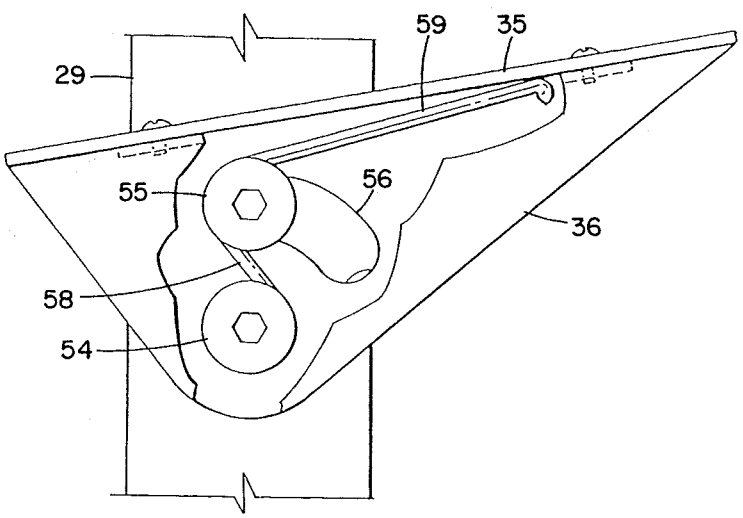
FIG. 11 is a side view with respect to FIG. 10.
Figure 10:
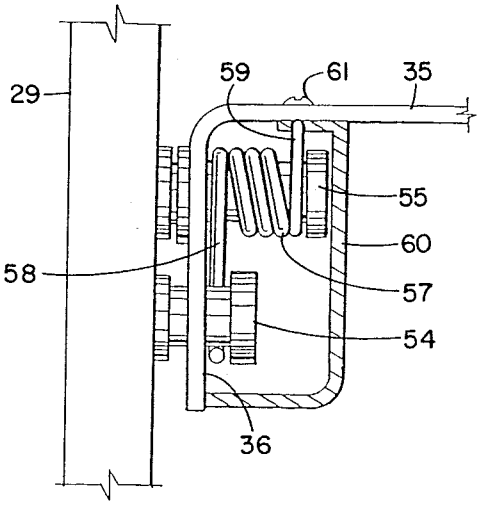
FIG. 10 is a rear elevation on an enlarged scale, showing the spring hinge mechanism connecting the seat to the frame.

Referring to FIGS. 10 and 11, the spring hinge assembly providing the pivotal relationship between the seat and the frame includes the pivot studs 54 traversing the flange 36, and engaging the side 29 of the frame. The stud is essentially a shoulder screw, secured to the inside surface of the frame with a conventional blind fastener. A similar shoulder screw functions as a limit stud 55, which traverses the arcuate opening 56 in the flange 36 to determine the freedom of tilting movement of the seat with respect to the frame. A coil spring 57 surrounds the limit stud 55, with the opposite ends extending tangentially. The end 58 engages the pivot stud 54, and the end 59 bears against the underside of the saddle. The result of this assembly is to produce a biasing action tending to retract the seat. The entire assembly is preferably covered by a housing 60 secured to the saddle by screws as shown at 61. The assembly shown in FIGS. 10 and 11 can be provided at both sides of the chair or one side can consist of a simple pivot.

Figure 14:
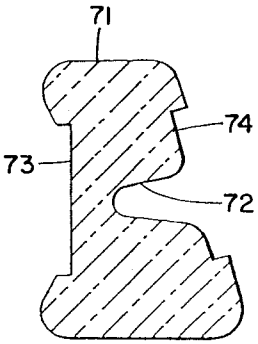
FIG. 14 is a view of the pad interposed between the hinge components shown in FIGS. 12 and 13.
Figure 13:
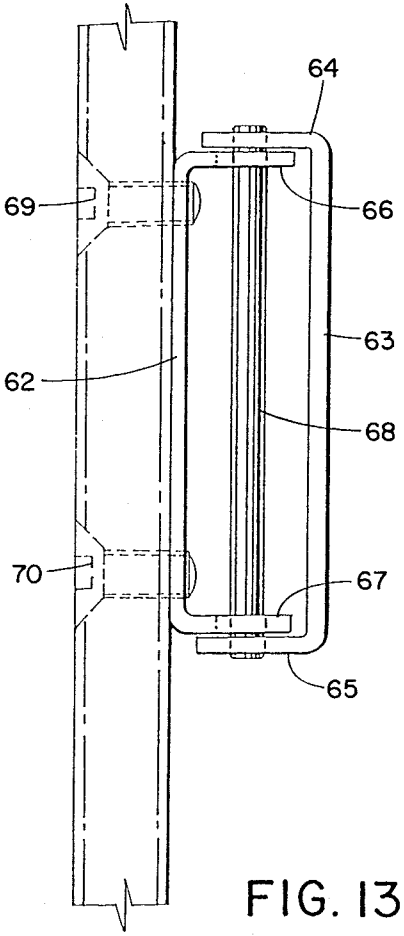
FIG. 13 is a top view with respect to FIG. 12.
Figure 12:
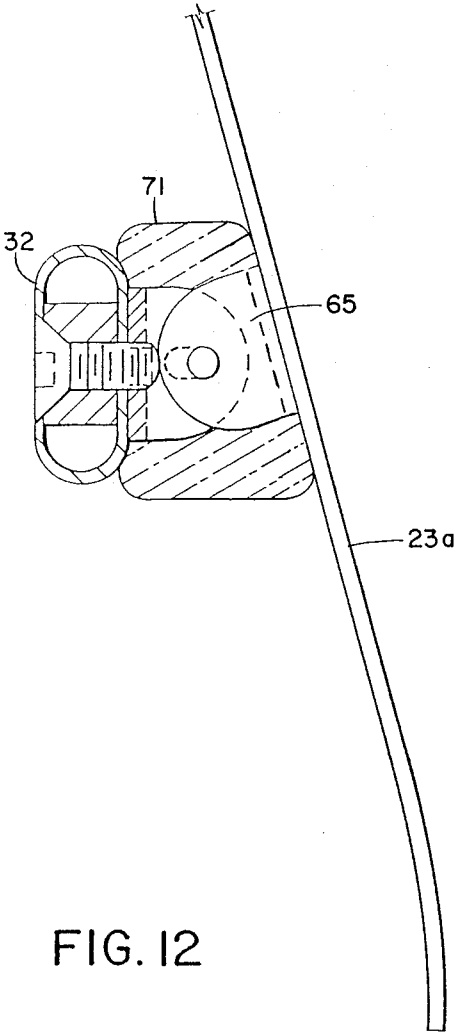
FIG. 12 is a sectional side elevation showing the articulating connecting the back to the frame.

Referring to FIGS. 12–14, the articulating support for the back includes the interleaved "U"-shaped brackets 62 and 63, each having end tabs as shown at 64–67. These tabs are traversed by the hinge pin 68. The tabs 66 and 67 have elongated openings, permitting the hinge pin 68 to move to a limited extent in a horizontal plane. The resulting hinge connection provides for pivot action on a horizontal axis, as well as articulation to a limited degree about a vertical axis to accommodate the back to the position of the occupant of the chair. The central portions of the brackets 62 and 63 are attached respectively to the base panel **23*a* of the back unit 23, and to the back portion 32 of the frame, the latter being accomplished by screws as shown at 69 and 70. The biasing action of this articulated joint is provided by the resilient pad 71 formed of rubber or the like interposed between the central portions of the brackets 62 and 63 under a slight degree of compression. The pad not only biases the back unit forwardly with respect to the frame, but also provides a neutral position of the back in the absence of an occupant of the chair. The configuration of the pad 71 is shown in FIG. 14. A slot is provided as shown at 72 to receive the pin 68, and the opposite faces of the pad are recessed at 73 and 74 to receive the central portions of the brackets 62 and 63. This arrangement makes it possible for the pad to exert relatively uniform pressure against the central portions of the brackets, and additionally against the surface of the back panel 23*a***.

Figure 15:
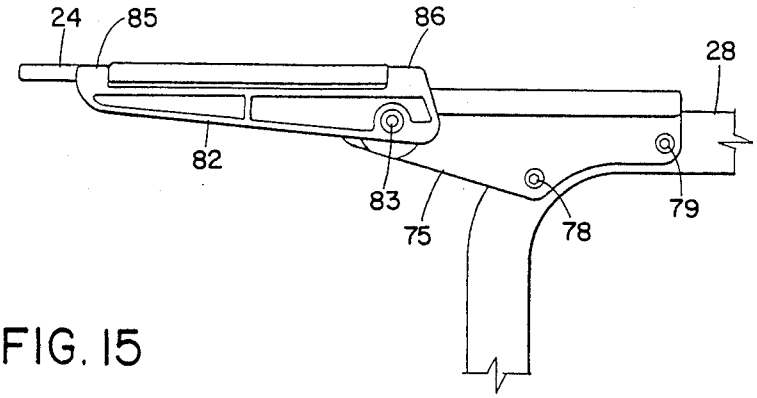
FIG. 15 is a side elevation showing the structure for supporting the tablet arm illustrated in FIG. 4.
Figure 16:
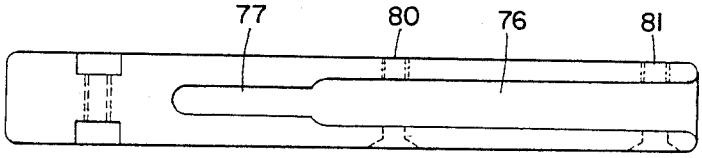
FIG. 16 is a bottom view of the bracket shown in FIG. 15 supporting the tablet arm structure.
Figure 17:
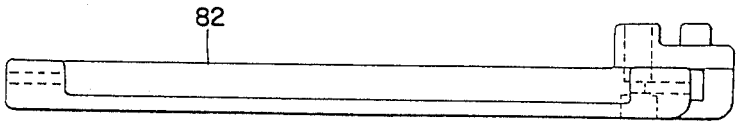
FIG. 17 is a top view of the pivoted extension arm supporting the tablet arm panel.

Referring to FIGS. 15–17, the structure for supporting the tablet arm includes the cantilever bracket 75 having the recess 76 which fits over the arm support portion of the frame. A slot as shown at 77 in FIG. 16 extends beyond the recess 76, to provide a degree of lateral resilience permitting the screws 78 and 79 to draw the sides of the bracket together and grasp the frame securely. Embracing the curved portion of the frame where the sides merge into the arm supports increases the solidity of the mounting of the arm, as well as locating the screws 78 and 79 fairly near the midline of the frame so that their traversing of the frame has a minimal effect on the frame strength. Preferably the screws engage threaded holes on the inside wall of the arm, as shown at 80 and 81 in FIG. 16.

The arm extension 82 is pivotally connected to the bracket 75 at 83. This arm, as well as the tablet panel 24, are conventional in construction. The arm is capable of swinging the table panel 24 upwardly, and the hinge connection of the panel 24 to the arm 82 permits the panel then to be rotated into a vertical front-rear plane at the side of the chair where it does not interfere with an occupant being seated or leaving. This panel hinge is formed by a pin traversing the bosses 85 and 86 on the arm 82 as well as the edge of the panel 24 itself.

For appearance, it is preferable to conceal the structure under the seat with a cover 87 secured in place by snap-on clips as shown at 88 in FIG. 8. This cover is preferably a molded plastic piece formed to contact the margin of the underside of the seat. The clips engage the cantilever rod 38, which forms a convenient point adjacent the margins to hold the cover in place.

I claim:

1. A seat frame comprising:

an elongated structural member forming a loop, the ends of said loop being brought together in a "Y" configuration to form a pedestal, the opposite side of said loop extending upward from said "Y" configuration and curving to a substantially horizontal plane in a "U" configuration to form arm and back support sections.

2. A frame as defined in claim 1, additionally including a base plate secured to said ends.

3. A frame as defined in claim 2, wherein said member is a continuous steel tube.

4. A frame as defined in claim 3, wherein said tube has a cross-section formed by substantially parallel sides joined by arcuate front and rear portions at said pedestal and frame sides, and becoming upper and lower portions at said "U" configuration.

5. A flexible mounting for a back of a chair including oppositely facing "U" brackets each having parallel tabs with aligned openings and a panel connecting said tabs, and also including a hinge pin traversing said openings, wherein the improvement comprises:

a resilient pad interposed between said panels, certain of said openings being elongated to provide a limited freedom of movement of said hinge pin, and of said brackets with respect to each other.

6. A mounting as defined in claim 5, in combination with a back unit having a rear structure secured to one of said bracket panels, said pad bearing on a portion of said rear structure.

7. A mounting as defined in claim 6, wherein said pad has recesses receiving the thickness of said bracket panels.

8. A mounting as defined in claim 5, wherein said pad has a slot receiving said hinge pin from a direction transverse to said hinge pin.

9. A seat structure, comprising:

a saddle providing a central support panel and opposite end flanges having means adapted to secure said seat structure to a frame;

a "U"-shaped cantilever spring rod extending forwardly from said saddle, said saddle being secured to the ends of said rod, respectively;

seat plate means secured to the central portion of said rod; and resilient seat pad means interposed between said support panel and seat plate means.

10. A seat structure as defined in claim 9, additionally including a cushion unit resting on said seat plate means, and secured thereto.

11. A seat structure as defined in claim 9, wherein said rod is offset upward from said saddle to place the central portion of said rod substantially coplanar with the top of said resilient seat pad.

12. A seat structure as defined in claim 9 in combination with a frame having spaced side sections, wherein said means for securing said seat structure to a frame includes a spring hinge assembly having a pivot member mounted on at least one of said side sections, said pivot member being received in a hole in one of said saddle end flanges, said flange having an arcuate slot concentric with said pivot member hole, and also including a spring-retainer stud traversing said arcuate hole and secured to said side section, and coil spring means surrounding said stud, the ends of said spring extending tangentially to bear on said saddle and said pivot member, respectively.

13. A seating assembly including a frame, a seat pivotally mounted on said frame on a horizontal transverse articulation axis, and a back mounted for articulation on said frame, wherein the improvement comprises:

an elongated structural member constituting said frame and forming a loop, the ends of said loop being brought together at a pedestal, the opposite sides of said loop extending upward and curving to a substantially horizontal plane in a "U" configuration to form arm and back support sections;

a flexible mounting for said back including oppositely facing "U" brackets each having parallel tabs with aligned openings and a panel connecting said tabs, and also including a hinge pin traversing said openings and a resilient pad interposed between said panels, certain of said openings being elongated to provide a limited freedom of movement of said hinge pin, and of said brackets with respect to each other, one of said bracket panels being secured to said frame, and the other thereof to said back; and a structure for said seat including a saddle providing a central support panel and opposite end flanges having means adapted to secure said seat structure to said frame, a "U"-shaped cantilever spring rod extending forwardly from said saddle, said saddle having receptacles receiving the ends of said rod, respectively, seat plate means secured to the central portion of said rod, and resilient seat pad means interposed between said support panel and seat plate means.

14. An assembly as defined in claim 13, wherein said frame member is a continuous steel tube.

15. An assembly as defined in claim 14, wherein said tube has a cross-section formed by substantially parallel sides joined by arcuate front and rear portions at said pedestal and frame sides, and becoming upper and lower portions at said frame "U" configuration.

16. An assembly as defined in claim 13, wherein said seat structure additionally includes a cushion unit resting on said seat plate means, and secured thereto.

17. An assembly as defined in claim 16, wherein said rod is offset upward from said receptacles to place the central portion of said rod substantially coplanar with the top of said resilient seat pad.

18. An assembly as defined in claim 13, wherein said means for securing said seat structure to said frame includes a spring hinge assembly having a pivot member mounted on at least one of said frame side sections, said pivot member being received in a hole in one of said saddle end flanges, said flange having an arcuate slot concentric with said pivot member hole, and also including a spring-retainer stud traversing said arcuate hole and secured to said side section, and coil spring means surrounding said stud, the ends of said spring extending tangentially to bear on said saddle and said pivot member, respectively.

19. An assembly as defined in claim 13, additionally including a cover extending below said spring rod and saddle, and secured by clip means engaging said rod.

20. In combination with a seat including a frame formed by a member having a portion curving from a vertical frontal portion to a horizontal portion to form an arm support, a tablet arm assembly comprising:

a bracket having an arcuate recess conforming to the configuration of said curving and horizontal portions;

means securing said bracket to said member; and tablet arm means mounted on said bracket.

21. A tablet arm assembly as defined in claim 19, wherein said frame member has a cross-section elongated in a vertical direction, and said bracket embraces and clasps at least the upper portion of said cross-section.

* * * * *